US005299391A

United States Patent [19]

Williams

[11] Patent Number: 5,299,391

[45] Date of Patent: Apr. 5, 1994

[54] FLAPPER WHEEL ADAPTER

[76] Inventor: Wilson E. Williams, 1117 W. Carpenter, Jerseyville, Ill. 62052

[21] Appl. No.: 928,500

[22] Filed: Aug. 11, 1992

[51] Int. Cl.[5] ..... B24B 41/00

[52] U.S. Cl. ..... 51/168; 51/334; 51/378

[58] Field of Search ..... 51/166 R, 168, 378, 51/334, 170 R, 170 PT, 170 T, 376

[56] References Cited

U.S. PATENT DOCUMENTS 1,753,377 4/1930 Jackson ..... 51/168
3,561,173 2/1971 Block ..... 51/334
4,455,788 6/1984 Freerks ..... 51/168

*Primary Examiner*—Roscoe V. Parker
*Attorney, Agent, or Firm*—J. E. Brunton

[57] ABSTRACT

An easy-to-use adapter assembly that will permit sanding flapper wheels of various sizes to be conveniently used in the field with portable hand held electric grinders of conventioonal design. The assembly is preferably sold as a set that includes connectors of various lengths that can accommodate drive shafts of different sizes so that the assemblage can be conveniently used in connection with flapper wheels of various thickness having spindle receiving apertures of various sizes.

9 Claims, 2 Drawing Sheets

FLAPPER WHEEL ADAPTER

BACKGROUND OF THE INVENTION

1. Field of the Invention

The present invention relates generally to adapters for use in connecting work engaging implements to drive shafts of motorized tools. More particularly, the invention concerns an adapter assembly for use in removably connecting a sanding flapper wheel to the drive shaft of a hand held portable grinder.

2. Discussion of the Invention

Sanding flapper wheels of various sizes are typically used with fixedly mounted bench grinders for accomplishing a number of different types of sanding operations in the workshop. These types of sanding wheels could also advantageously be used in the field for accomplishing of a number of tasks. However, the drive shafts of easily portable grinder machines, such as portable electric grinders, while able to accept thin sanding discs are typically not able to accept the much thicker sanding flapper wheels. For this reason, the use of the flapper wheels has for the most part been restricted to work which can be accomplished in the machine shop. Because a number of sanding operations can be done in a superior fashion with the flapper wheel rather than the sanding disc, a substantial need has arisen for an adapter assembly that can permit interconnection of the standard, relatively wide flapper wheel with the drive shaft of the portable hand held electric grinder.

The thrust of the present invention is to satisfy the need to adapt portable grinders so that they can accept standard flapper wheels by providing a simple, easy to use and highly versatile adapter assembly that will permit sander flapper wheels of various sizes to be operably interconnected with the standard hand held grinders.

SUMMARY OF THE INVENTION

It is an object of the present invention to provide a simple, easy-to-use adapter assembly that will permit sanding flapper wheels of various sizes to be conveniently used in the field with portable hand held grinders of conventional design.

Another object of the invention is to provide an assembly of the aforementioned character which is easy to use and can be sold as a set that includes connectors of various lengths that can accommodate drive shafts of different sizes so that the assemblage can be conveniently used in connection With flapper wheels of various thickness as well as those having spindle receiving apertures of various sizes.

Another object of the invention is to provide an adapter assembly that includes uniquely configured compression washers for securely clamping the hub portions of the flapper wheels.

Another object of the invention is to provide an assembly as described in the preceding paragraphs which is durable and reliable in operation and one which can be inexpensively manufactured in quantity.

DESCRIPTION OF ONE FORM OF THE INVENTION

Figure 1:
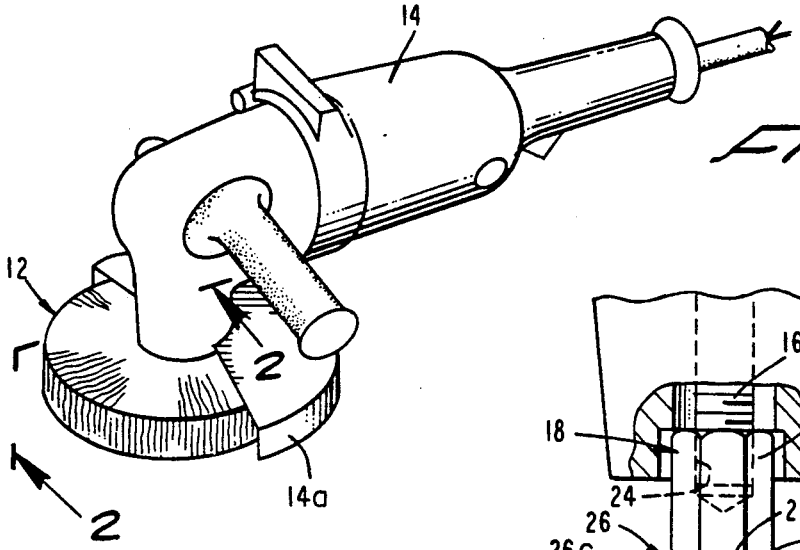
FIG. 1 is a generally perspective view of a portable, hand held electric grinding machine to which a commercial type sanding flapper wheel has been interconnected by means of the adapter assembly of the present invention.
Figure 2:
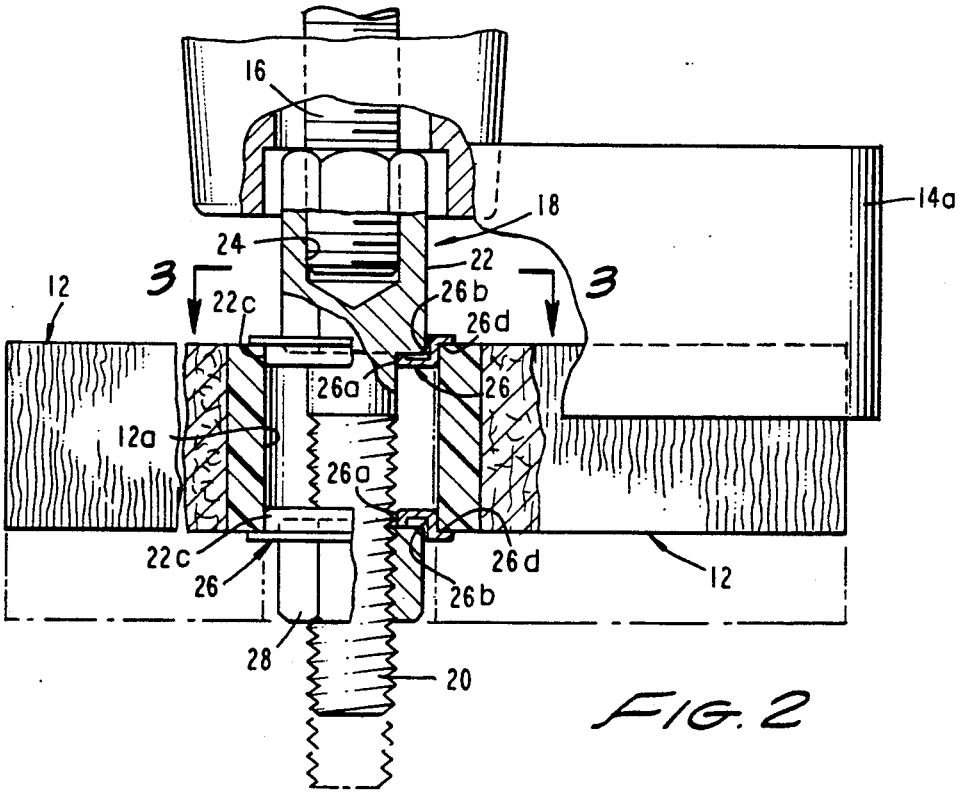
FIG. 2 is a greatly enlarged cross-sectional view taken along lines 2—2 of FIG. 1.
Figure 4:
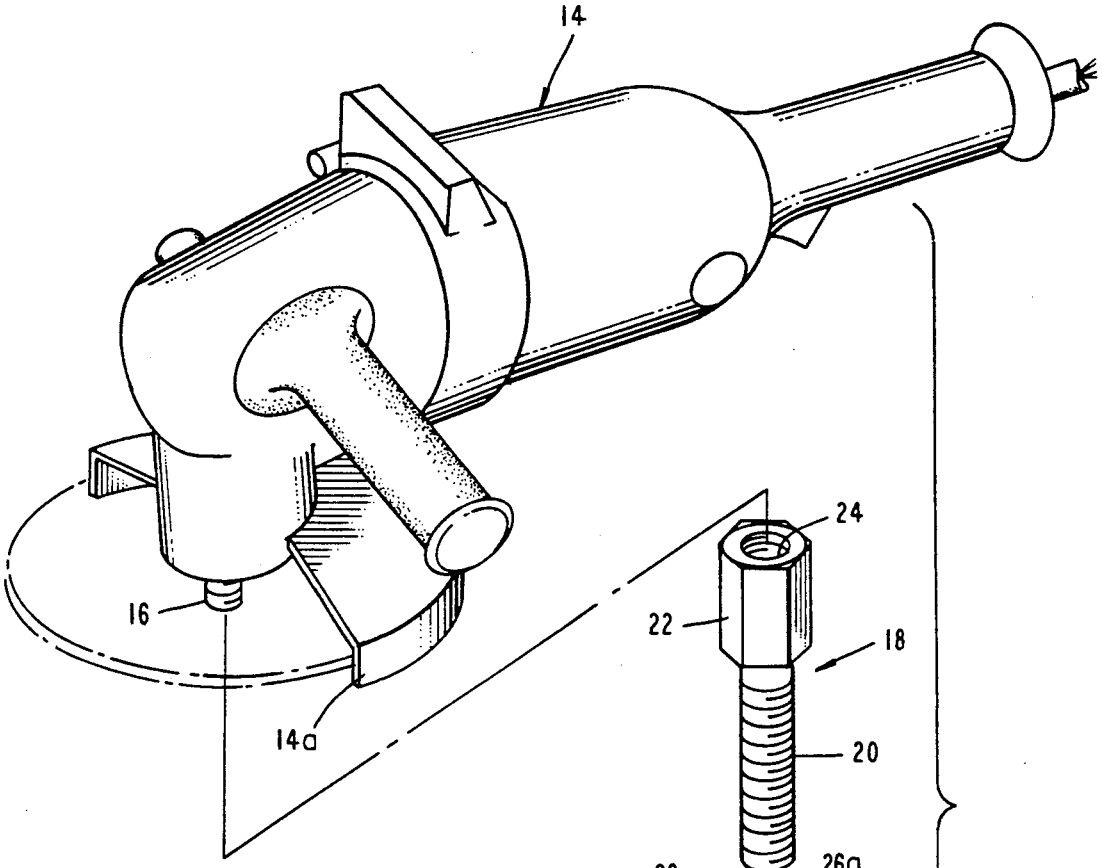
FIG. 4 is an enlarged, generally perspective, exploded view of a hand held portable grinder showing the manner in which the adapter assembly of one form of the invention is used to connect a flapper wheel of standard design to the hand held grinder.
Figure 3:
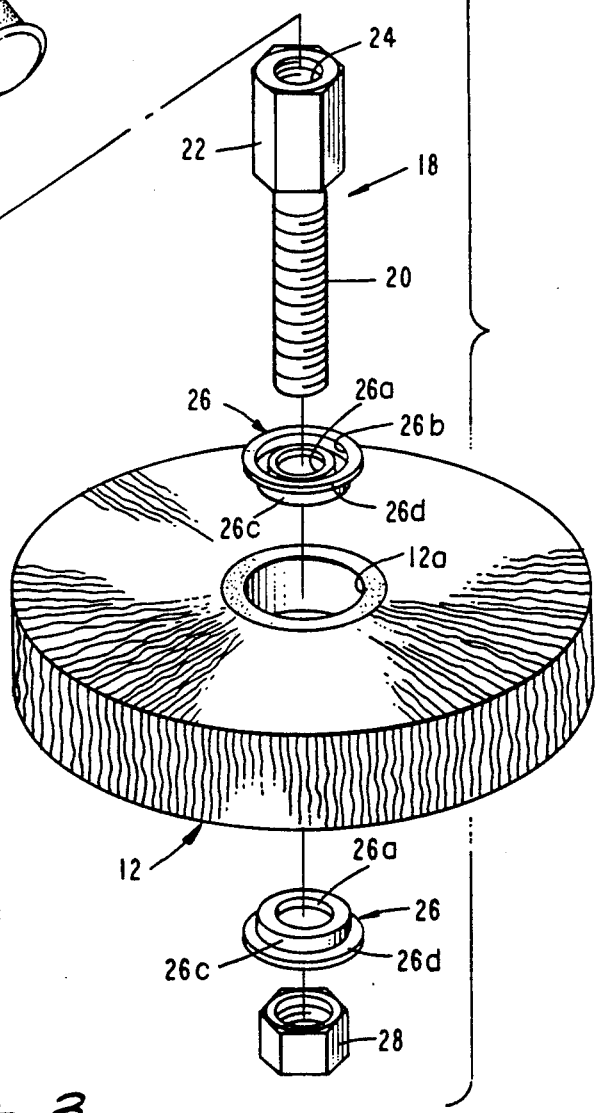
FIG. 3 is a cross-sectional view taken along lines 3—3 of FIG. 2.
Figure 3:
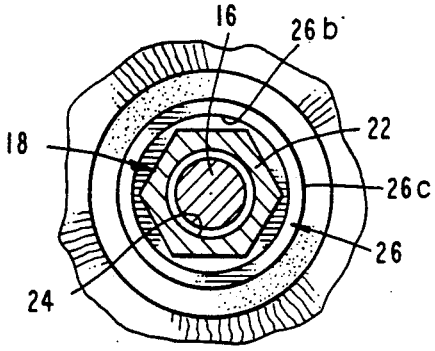

Referring to the drawings and particularly to FIGS. 1, 2 and 4, there shown is one form of the adapter; assembly of the present invention for use in interconnecting a flapper sanding wheel 12 with a hand held, portable grinder 14 of the character having an externally threaded drive shaft 16 (FIG. 2). The adapter assembly of the invention is usable with a number of different types of commercially available grinders including an electric grinder sold by Black & Decker Company and identified by the Serial Number 2750 and a portable electric grinder sold by Jepson Company under the Model Number 4307. Sanding flapper wheels usable with the adapter assembly of the present invention are readily commercially available in various thicknesses having arbor holes of various sizes. For example, such flapper sanding wheels are available from the Merit Company and sold are under Model Numbers 31509, 22551, and 22559.

One form of the adapter assembly of the present invention comprises a first member 18 having an elongated, externally threaded shaft 20 of a first length. First member 18 is provided with a generally, hexagonally shaped head portion 22 which has an internally threaded bore 24 of a first diameter for threadably receiving drive shaft 16 of the portable hand grinder. As indicated in the drawings, internally threaded bore 24 is co-axially aligned with externally threaded shaft 20 of the first member 18. Head portion 22 can be integrally formed with shaft 20 or it can comprise a separate unit which can be suitably interconnected with shaft 20. The assembly of the embodiment of the invention shown in FIG. 4 also comprises first and second identically configured compression washers 26. Each of the washers 26 has a central aperture **26*a* adapted to closely receive shaft 20 of the first member and is provided with an annular shoulder 26*b*, the purpose of which will presently be described. Completing the assembly is a hexagonally shaped, internally threaded nut 28 which is adapted to be threadably interconnected with externally threaded shaft 20 of first member 18**.

As best seen by referring to FIG. 2, when the adapter assembly of the invention is used to mount a flapper wheel 12 to the drive shaft 16 of a hand held grinder, the lower end of hexagonal head 22 of the first member is received within the socket **26*b* of the proper size upper washer 26 and the upper portion of the hexagonal nut 28 is received within socket 26*b* of the proper size lower washer 26. The cylindrical body portions 26*c* of the washers are closely received within the central aperture 12*a* of the flapper wheel so that the flat surface portions 26*d* of the compression washers engage the hub portions of the flapper wheels so as to precisely center and securely clamp the wheel in position on shaft 20. Washers 26 are, of course, selected so that the body portions 26c** fit closely within the central bore of the flapper wheel.

The adapter assembly of the present invention is preferably sold as a kit containing at least one adapter shaft having a first length of, for example, two and one-half inches and at least one adapter having a second length of, for example, three inches. The adapter shafts are typically either five-eighth inch in diameter or three-eighth inch in diameter. For certain applications, the kit may also contain one member having a length of one and one-quarter inch and a diameter of three-eighth inch.

The kits containing the five-eighth inch diameter adapter shaft will include two sets of compression washers 26. One set will have a five-eighth inch arbor aperture and a one inch outside diameter, and the other set will have a five-eighth inch arbor aperture and a one and three-quarter inch outside diameter. In this way, an appropriate first member can be selected to accommodate the different size arbor holes typically provided in commercially available sanding flapper wheels. To complete the assembly, the adapter assembly kits will also contain one or more appropriately sized hex nuts 28 to complete the assembly. The units containing the three-eighth inch by one and one-quarter inch shaft will contain one set of compression washers 26 each having a three-eighth inch diameter arbor aperture and a one inch outside diameter. These kits will, of course, also include a hex nut having a three-eighth inch internally threaded bore.

The adapter shaft having the five-eighth inch diameter and either the two and one-half inch or three inch shaft length is designed to fit a commercially available seven inch electric grinder that has a five-eighth inch externally threaded drive shaft. The adapter shaft having a diameter of three-eighth inch and a length of one and one-quarter inch is designed to fit a four inch grinder as, for example, of the character commercially available from Mikita Company.

Figure 5:
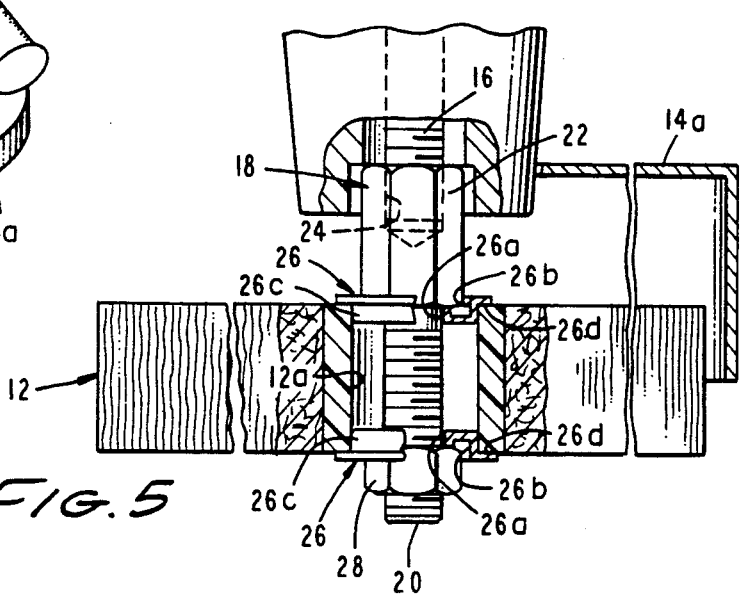
FIG. 5 is a cross-sectional view showing a flapper wheel of a different thickness interconnected with the drive shaft of a hand held portable grinder using the adapter assembly of the present invention.

In using the adapter assembly of the present invention, the diameter of the drive shaft of the particular tool is first determined. This done, an appropriate first member having an internally threaded bore 24 of a size compatible with the drive shaft of the tool is selected. Next, the thickness of the flapper wheel to be used is determined and an appropriate first member having both the compatible bore size and a shaft length sufficient to accommodate the flapper wheel is selected. The first member is then threadably interconnected with the drive shaft 16 of the portable grinder. Next, a compression washer 26 of the correct size is placed socket up over shaft portion 20 of the first member, the flapper wheel is then inserted over the shaft portion as is the second compression washer. Finally, the hex nut 26 is interconnected with the outboard end of shaft 20 of the appropriate first member and is snugged down into the socket of the lower compression washer in the manner shown in FIGS. 2 and 5 so that the flapper wheel is accurately centered and securely clamped in position between surfaces 26c of the two compression washers 26.

Depending upon the design of the portable grinder and the thickness of the flapper wheel to be used, it may be necessary in some instances to remove the guard 14a which is normally provided on the portable grinder. When this is done, extreme caution must be exercised in using the portable hand grinder and, after use with the flapper wheel, it is imperative that the guard 14a be reconnected to the portable hand tool.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An adapter assembly for use in interconnecting a flapper sanding wheel of the type normally used with a bench grinder with a hand held portable grinder of the character having an externally threaded drive shaft, comprising:

(a) a first member having:
  (i) an elongated externally threaded shaft, having a first length; and
  (ii) a head portion interconnected with said externally threaded shaft, said head portion having an internally threaded bore of a first diameter co-axially aligned with said shaft for threadably receiving the drive shaft and at least two wrench engaging flats;

(b) first and second compression washers, each said washer having a circumferentially extending flange for engaging the sides of the flapper sanding wheel and a central aperture for receiving said externally threaded shaft of said first member; and (c) a nut for threadable engagement with said externally threaded shaft.

2. An assembly as defined in claim 1 further including a second member having an elongated externally threaded shaft having a second length and a head portion connected thereto having an internally threaded bore of a second diameter.

3. An assembly as defined in claim 2 in which said head portions of said first and second members are receivable within said socket portions of said compression washers.

4. An assembly as defined in claim 3 in which said head portions of both said first and second members are hexagonal in cross-section.

5. An adapter assembly for use in interconnecting flapper sanding wheels of the type normally used with a bench grinder and having first and second widths with a hand held portable grinder of the character having an externally threaded drive shaft, comprising:

(a) a first member having:
  (i) an elongated externally threaded shaft, having a first length; and
  (ii) a generally hexagonally shaped head portion integrally formed with said externally threaded shaft, said head portion having an internally threaded bore of a first diameter co-axially aligned with said shaft for threadably receiving the drive shaft;

(b) a second member having:
  (i) an elongated, externally threaded shaft having a second length;
  (ii) a generally hexagonally shaped head portion integrally formed with said externally threaded shaft, said head portion having an internally threaded bore of a second diameter co-axially aligned with said shaft for threadably receiving the drive shaft;

(c) first and second compression washers, each said washer having a socket portion and a flat surface portion for engaging the sides of the flapper sanding wheel and a central aperture for receiving said externally threaded first and second shafts of said first member; and (d) a nut for threadable engagement with said external threaded first and second shafts.

6. An assembly as defined in claim 5 in which said head portions of said first and second members are receivable within said socket portions of said compression washers.

7. An assembly as defined in claim 6 in which said externally threaded shaft of said first member is about two and one-half inches in length and said externally threaded shaft of said second member is about three inches in length.

8. An assembly as defined in claim 7 in which each of said first and second members is provided with a head portion having an internally threaded bore of about five-eighth inch in diameter.

9. An assembly as defined in claim 7 further including a third member having:

(i) an elongated, externally threaded shaft having a length of about one and one-quarter inches;

(ii) a generally hexagonally shaped head portion integrally formed with said shaft, said head portion having an internally threaded bore of about three-eighth inch in diameter.

* * * * *